United States Patent [19]

Barrineau, III

[11] 4,231,301

[45] Nov. 4, 1980

[54] ADJUSTABLE SHELF ASSEMBLY

[76] Inventor: Wade H. Barrineau, III, 5159 E. Shore Dr., Conyers, Ga. 30207

[21] Appl. No.: 783,568

[22] Filed: Aug. 29, 1977

Related U.S. Application Data

[63] Continuation-in-part of Ser. No. 628,133, Nov. 3, 1975, abandoned, and a continuation-in-part of Ser. No. 737,401, Nov. 1, 1976.

[51] Int. Cl.[2] ..... A47B 57/04; A47B 57/20

[52] U.S. Cl. ..... 108/146; 108/110; 211/153; 211/187

[58] Field of Search ..... 108/106, 107, 110, 111, 108/144, 146; 211/153, 187, 192; 312/351

[56] References Cited

U.S. PATENT DOCUMENTS

| | | | |
|---|---|---|---|
| 677,624 | 7/1901 | Beckwith | 108/110 |
| 714,220 | 11/1902 | Mohr | 108/110 |
| 721,404 | 2/1903 | Wege | 108/144 |
| 777,256 | 12/1904 | Holden | 211/153 |
| 2,684,884 | 7/1954 | Devery | 312/351 |
| 2,933,195 | 4/1960 | Radek | 211/153 |
| 2,970,702 | 2/1961 | Maslow | 108/106 |
| 3,154,028 | 10/1964 | Hamilton | 108/111 X |
| 3,168,365 | 2/1965 | Evans | 211/153 X |
| 3,330,229 | 7/1967 | Ferdinand et al. | 211/187 X |
| 3,669,520 | 6/1972 | Jansen | 312/351 |
| 3,680,938 | 8/1972 | Ohlsson | 211/187 X |
| 3,705,654 | 12/1972 | Barrineau | 108/110 |

FOREIGN PATENT DOCUMENTS

| | | | |
|---|---|---|---|
| 601755 | 7/1960 | Canada | 108/108 |

*Primary Examiner*—Roy D. Frazier
*Attorney, Agent, or Firm*—Wood, Herron & Evans

[57] ABSTRACT

An ajustable shelf assembly which, in a four corner post embodiment, preferably includes novel latch structure at each of the opposed front corners of the assembly. Each latch structure is comprised of a flex arm with a latch finger mounted on one end, the flex arm being connected to the shelf at the other end. The flex arm, which preferably is inherently flexible, is normally in a connect position generally parallel to the front edge of the shelf, the latch finger being received in a front corner post hole in that connect position, thereby connecting the shelf and corner post into a shelf assembly. The flex arm's latch finger is retracted from the connect position simply by depressing or flexing the flex arm out of the front edge parallel position by temporarily exerting a force thereon generally normal to the shelf's front edge, thereby permitting the shelf to be easily assembled with or disassembled from the corner post by exerting a manual force on the flex arm generally normal to the shelf's front edge.

1 Claim, 5 Drawing Figures

ADJUSTABLE SHELF ASSEMBLY

This application is a continuation-in-part of U.S. application Ser. No. 628,133, filed Nov. 3, 1975, now abandoned, and the cont. application U.S. Ser. No. 737,401, filed Nov. 1, 1976.

This invention relates to an adjustable shelf assembly. More particularly, this invention relates to an improved adjustable shelf assembly that incorporates a novel corner latch structure and assembly method.

Adjustable shelf assemblies are very well known to the prior art. Perhaps the most common structural embodiment of adjustable shelving is that which incorporates four corner posts, each of the corner posts having multiple shelf locations along the length of those posts from top to bottom. Multiple shelves are located within the corner post framework at the desired horizontal use locations. Of course, each corner of a shelf must be provided with a connector structure so that shelf corner can be connected with the adjacent corner post. One means for interconnecting shelves with corner posts is the nut and bolt. However, the nut and bolt connector structure is relatively time consuming to use in initial set up of the shelving. Further, the net and bolt connector structure makes it relatively difficult to move the shelf from one horizontal use location to another after the shelving has been initially assembled.

Latch structure of the quick connect/disconnect type, which latch structure is adapted to connect shelves with corner posts in an adjustable shelf assembly, is known to the prior art. Typical of such prior art structures are those illustrated in Wege U. S. Pat. No. 721,404, and Knuth Canadian Pat. No. 446,299. However, each of the latch structures illustrated in those patents have disadvantages from both fabrication and use standpoints. In the first instance, the latch structures illustrated in those patents are relatively costly to fabricate because of the multiple parts required. In the second instance, those latch structures are not particularly easy to use because of the force direction, relative to the front edge of the shelf, required to operate that latch structure. More particularly, the Wege and Knuth latch structures must be operated by manually applying a force, at each front corner of the shelf, in a direction parallel to the front edge of the shelf. But it is relatively difficult for an installer to apply manually a force in that direction while simultaneously locating the shelf at the desired horizontal use position.

Thus, it has been one objective of this invention to provide an improved adjustable shelf assembly that incorporates an improved latch structure for connecting a shelf to a corner post.

It has been another objective of this invention to provide an improved adjustable shelf assembly that includes a novel shelf latch structure for a corner post, that latch structure being fabricated as an integral and functional component of the shelf itself without separate parts being required therefor, and that latch structure being easily and simply operated by the shelf installer.

It has been a further objective of this invention to provide an improved adjustable shelf assembly that includes a novel shelf latch structure for a front corner post, that latch structure being easily used by an installer simply by exerting a force thereon generally normal to the shelf's front edge while simultaneously locating that shelf's front edge as desired relative to the assembly's corner post, that force being exerted by the installer simply by manually depressing a flex arm mounted to the shelf out of a normal connect position generally parallel to the shelf's front edge, and into a retract position in which a latch finger on that flex arm's free end is out of connected relation with the corner post, the flex arm returning to and remaining at the normal connect position when released in response to the inherent flexibility thereof.

In accord with the principles of this invention, the improved adjustable shelf assembly, in a four corner post embodiment, includes novel latch structure at least at each of the opposed from corners of the assembly. Each latch structure, is comprised of a flex arm with a latch finger mounted on one end, the flex arm being connected to the shelf at the other end. The flex arm, which preferably is inherently flexible, is normally in a connect position generally parallel to the front edge of the shelf, the latch finger being received in a front corner post hole in that connect position, thereby connecting the shelf and corner post. The corner post hole is preferably disposed on a front-to-rear axis, relative to the shelf's front and rear edges, to permit the latch finger to be extended into or retracted from the hole, i.e., to permit the shelf to be assembled with or disassembled from the corner post, simply by depressing or flexing the flex arm out of the connect position by temporarily exerting a force thereon generally normal to the shelf's front edge.

In assembly of the shelf with the corner posts, the shelf is tilted front-to-rear so that the rear edge can first be located in the desired use position, the shelf's rear corners then being connected with the rear corner posts in that desired position. The shelf is thereafter pivoted about its rear edge from the tilted position into a horizontal use position. As the shelf's front edge is moved into a common horizontal plane with the shelf's rear edge, the installer manually flexes both the front corners' flex arms out of the connect position by exerting a force thereon generally normal to the shelf's front edge. In other words, the installer manually depresses those flex arms into an angled position relative to the shelf's front edge. This is an easy and natural manual step for the installer as the shelf's opposed rear corners are held in connected relation with the rear corner posts during this step. In the preferred structure, the installer exerts a front-to-rear force on the flex arms with the rear posts preventing rearward motion of the shelf as that force is exerted. After the shelf has been horizontally located, the flex arms are simply released by the installer. This permits the latch fingers to engage the front post holes at the desired horizontal position as the flex arms, which are inherently flexible, return to the connect position, thereby connecting the shelf and the front corner posts. Repositioning of the shelf at a newly desired use level is achieved by reversing, and then repeating, the assembly step sequence.

Other objectives and advantages of the invention will be more apparent from the following detailed description taken in conjunction with the drawings in which.

Figure 1:
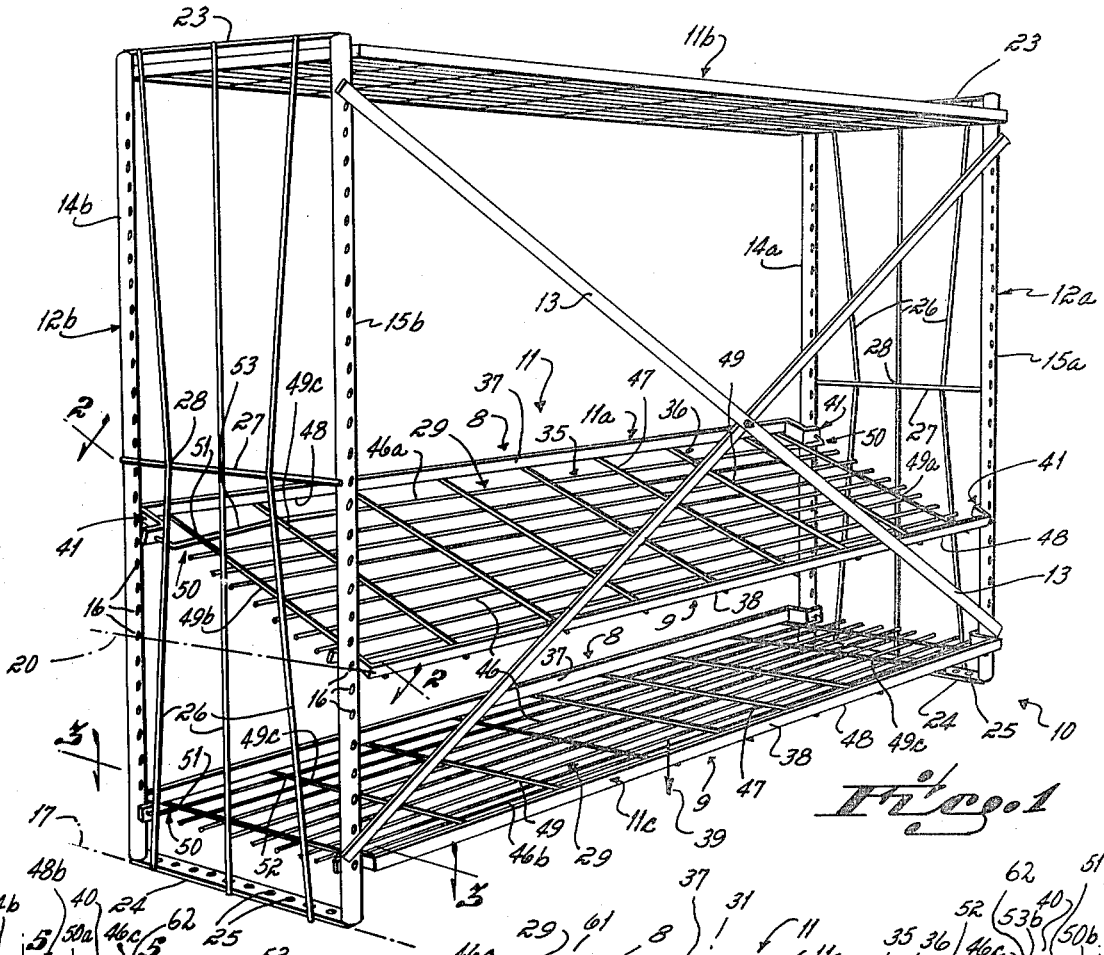
FIG. 1 is a perspective view illustrating an adjustable shelf assembly in accord with the principles of this invention.

The adjustable shelf assembly 10 of this invention is illustrated generally in FIG. 1. The adjustable shelf assembly 10 shown in that Figure is comprised of three shelves 11, one 11*a* of which is being installed and two 11*b*, 11*c* of which are installed. The shelf assembly, in addition to the shelves 11, includes two end frames 12*a*, 12*b*. The end frames 12 are tied together by tie straps 13. The shelves 11 each have a front edge 8 and a rear edge 9. For purposes of this application the term front edge refers to that edge which the installer faces during initial assembly of, or repositioning of, the shelves 11, and the term rear edge refers to that edge generally opposite to and generally parallel to that front edge.

More particularly, and with regard to the framework 12, 13 of the adjustable shelf assembly 10, each end frame 12 includes a front post 14 and a rear post 15. Note particularly that each post 14, 15 is provided with multiple holes 16 along the length thereof, the holes in the front post being aligned with the holes in the rear post relative to floor level 17, and all holes being front face 18 to back face 19 through each post as opposed to side face to side face through each post. In other words, and for each pair of holes 16 in the front 14 and rear 15 posts of an end frame 12, those holes are on a common axis 20 which lies in the plane 21 of that end frame. Further with regard to the holes 16, note that same are located in dimples 22 in the front 18 and back 19 surfaces of the post member, as particularly illustrated in FIG. 5. These dimples 22 are normally made when the holes 16 are punched into the tubular posts 14, 15. The purpose of the dimples 22 is explained further below.

The front 14 and rear 15 posts of each end frame 12 are connected at the top, and at the bottom, by cross frame members 23, 24, respectively. Each of the cross frame members 23, 24 is welded at one end to the front post 14 and at the other end to the rear post 15. Each of the top and bottom cross frame members 23, 24 is provided with multiple holes 25 along the length thereof. The holes 25 in the bottom cross frame member 24 permits the shelf assembly 10 to be permanently mounted to flooring in its use location. Additional rigidity is provided to each end frame 12 by vertical reinforcement rods 26 which are welded at the top to the top cross frame member 23 and at the bottom to the bottom cross frame member 24. A horizontal cross reinforcement rod 27 is welded at one end to the front post 14 and at the other end to the rear post 15. The vertical reinforcement rods 26 are welded to the cross reinforcement rod 27 at their respective contact points 28. Thus, an integral and rigid end frame 12, which is structurally reinforced, is provided at each end of the adjustable shelf assembly 12.

The end frames 12 may be held together by cross straps 13, the cross straps being disposed in an X-configuration in the rear face or plane 30 of the shelf assembly 10. One end of each cross strap 13 is bolted to the top of the rear post 15 of each end frame 12, and the other end of each cross strap is connected to the bottom of the rear post of the opposite end frame 12, those connections being provided by nut and bolt connectors (not shown in detail) known to the art. The cross straps 13 are further connected together at the contact center point thereof, thereby restraining the end frames 12 in upright relation relative one to the other even if no shelves are in interconnected relation therewith. Note particularly that the four corner posts 14*a*, 14*b*, 15*a*, 15*b* of the shelf assembly 10 thereby define the assembly's rear face plane 30, front face plane 31, and two opposed side planes 21*a*, 21*b*, the front 31 and rear 30 face planes being parallel one to the other, see FIGS. 2 and 3.

Figure 2:
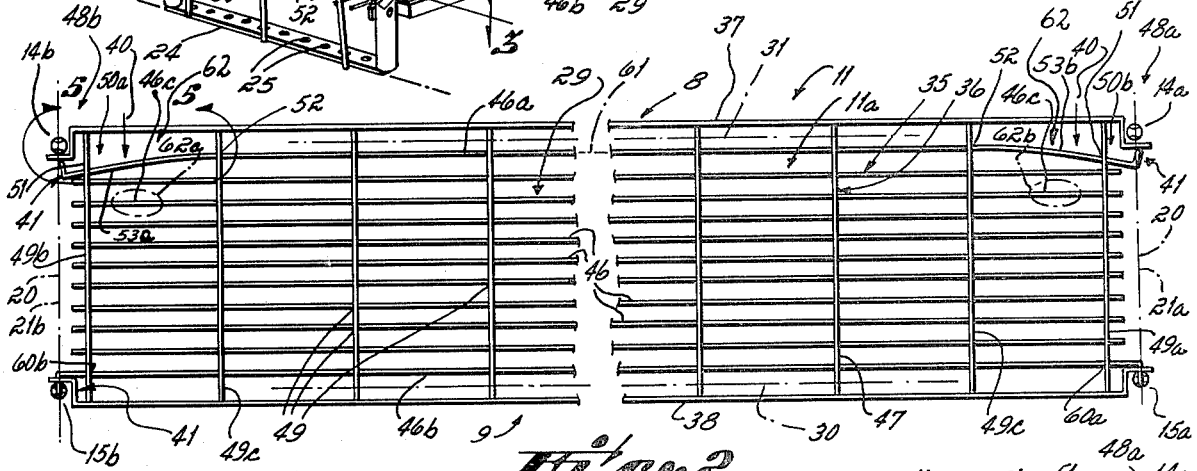
FIG. 2 is a cross-sectional view taken along line 2—2 of FIG. 1, that view illustrating in top plan view an intermediate or installation attitude of a shelf.
Figure 3:
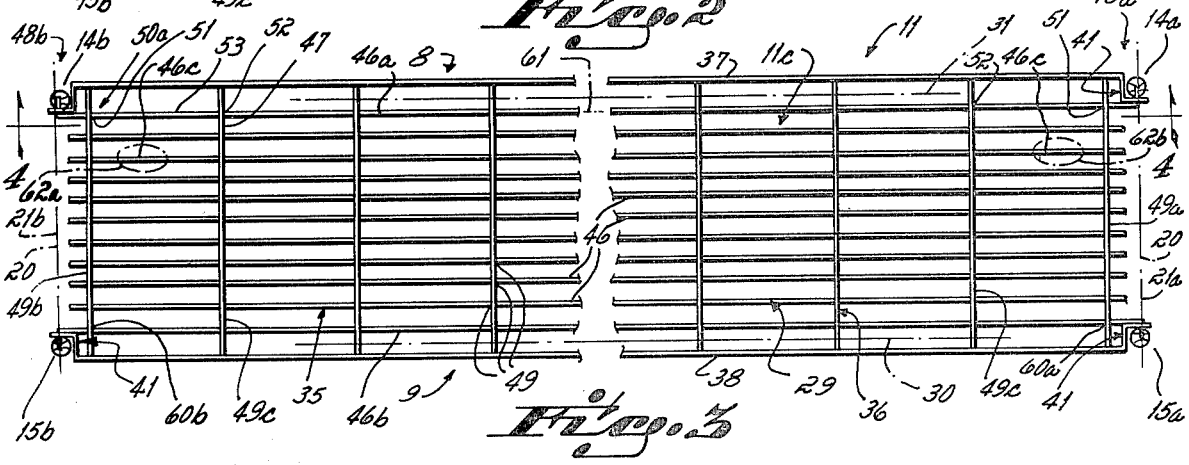
FIG. 3 is a cross-sectional view taken along line 3—3 of FIG. 1, that view being a top view illustrating the installed attitude of a shelf.
Figure 4:
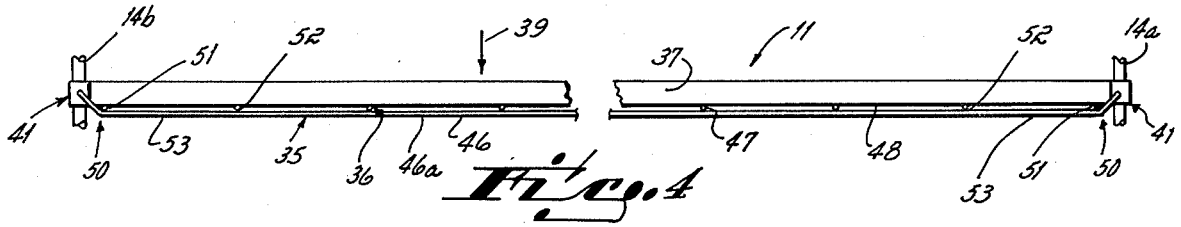
FIG. 4 is a cross-sectional view taken along line 4—4 of FIG. 3.

The structure of the shelves 11 adapted for use with the framework 12, 13 is particularly illustrated in FIGS. 2–4. As shown in those Figures, each shelf 11 is comprised of a plurality of longitudinal members 35 oriented generally parallel to the front 31 and rear 30 face planes of the shelf assembly 10, and a plurality of transverse members 36 oriented generally normal or perpendicular to the front and rear face planes of the shelf assembly. The longitudinal members 35 are comprised of a front band 37 and a rear band 38, those bands being of substantial width and strip-like configuration. The front 37 and rear 38 bands are oriented vertically, thereby providing vertical force 39 strength or rigidity to the shelf 11. While the front 37 and rear 38 bands are not bendable in a force direction illustrated by arrow 39, they may be bendable in a force direction illustrated by arrow 40 if, in fact, those bands were not fixedly connected to all transverse members 36 as described in greater detail below. Note that each end 41 of the front 37 and rear 38 bands is of an inwardly turned L-shaped or dog-leg configuration. Each dog leg 41 includes an inwardly turned leg member 42 disposed perpendicular to the band 37 or 38, and an outwardly turned foot member 43 disposed horizontal to the band and directed outwardly from the shelf. The inwardly turned leg 42 and the outwardly turned foot 43 of each dog leg 41 cooperate to define a seat 44 in which a vertical corner post 14 or 15 is embraced, see FIG. 5. Each dog leg 41, in effect, tends to support a corner post 14 or 15 on the inner side face 45 and the rear face 19 thereof when the shelves 11 are assembled with those corner posts 14, 15, thereby providing additional rigidity to the shelf assembly 10 which, in turn, tends to prevent side-to-side sway of that shelf assembly.

Each shelf 11 is in the nature of a grid which comprises the front 37 and rear 38 bands previously described, as well as a plurality of support wires 46 disposed parallel to those bands, and a plurality of cross wires 47 disposed transverse to those bands. As illustrated in FIGS. 2 and 3, the transverse support wires 47 extend between the front 37 and rear 38 bands, and are welded at each end to the bottom edge 48 of those bands, see FIG. 4. The longitudinal support wires 46 are welded at all cross intersections 49 with the transverse support wires 47, and the longitudinal support wires 46 terminate adjacent the end planes 21*a*, 21*b* of the shelf assembly. Thus, the front 37 and rear 38 bands, the longitudinal support wires 46, and the cross support wires 47 are welded integral one with another to form a rigid shelf 11.

Latch structure 50 of the quick connect/disconnect type is provided adjacent each of the two front corners 48*a*, 48*b* of the shelf assembly. The latch structure 50 for the front corners 48*a*, 48*b* of the shelf, i.e., those corners at the shelf's front edge 37, is formed as an integral part of the first or frontmost longitudinal support wire 46*a*, i.e., as an integral part of the shelf 11, as is particularly illustrated in FIGS. 2 thru 5. With the latch structure 50 so formed, that longitudinal support wire 46*a* is welded to all cross wires 49 except the end cross wires 49*a*, 49*b*. In other words, and with the latch structure 50 being formed as part of the first longitudinal cross wire 46*a*, that longitudinal cross wire is not welded at that point 51 where it crosses the transverse wires 49*a*, 49*b*. The latch structure 50 at each front edge 37 corner includes a flex arm 53 which is part of the longitudinal support wire 46*a*. That flex arm 53 is of a length L, and is flexible or pivotable relative to point 52 where wire 46*a* is welded to the transverse cross wire 49*c*, thereby defining a vertical flex or pivot axis 54. Thus, the flex arm 53 is in the nature of a leaf spring which, because of the inherent resiliency or spring characteristics of the steel wire from which it is fabricated, is normally biased to and located in that solid line or connect position illustrated in FIG. 5, but which is movable to a phantom line or disconnect position illustrated in FIG. 5 upon force being exerted thereon in force direction 40. Note particularly that the force direction 40 is substantially normal or perpendicular to the front edge 37 of the shelf 11. Also note particularly, that each flex arm 53 is disposed adjacent an immobile grip, i.e., grip means, in the form of fixed longitudinal wires 46 that can easily be grabbed by an installer's hand in the area 62 designated in phantom outline as shown in FIGS. 2 and 3. This grip 62, of course, is also an integral part of shelf 11.

Figure 5:
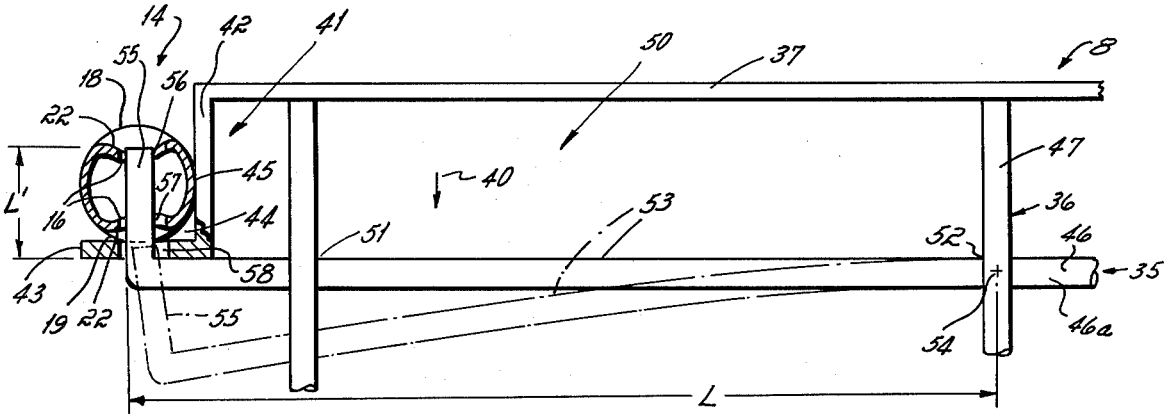
FIG. 5 is an enlarged view of that area encircled on FIG. 2, that enlarged view illustrating the connect/disconnect features of a novel latch structure with a corner post at one of the shelf's front corners.

A latch finger 55 is carried on the free end of the flex arm 53, that latch finger being oriented perpendicular to the flex arm and, therefore, generally parallel to, and within, the side plane 21 of the shelf assembly 10 when in connect position, see FIGS. 3 and 5. The latch finger 55, when in the connect position, is received in holes 16 within the adjacent front corner post 14. Note particularly that the length L′ of each latch finger 55 is sufficient to pass through both holes 16 in the post 14, as illustrated in FIG. 5, thereby providing two points 56, 57 of support for that latch finger (and, therefore, for the shelf itself) at each front corner post. Note also that each latch finger 55 extends through port 58 in the dog leg's foot 43 at the end of front band 37 prior to engaging post 14, thereby providing vertical immobility to the latch finger in response to downward force 39, i.e., weight, on the shelf 11. Such vertical immobility is required because of the inherent flexibility of the flex arm 53 with which that latch finger 55 is integrally formed. Thus, and in effect, the flex arm 53 and latch finger 55 are immobile vertically when the shelf is horizontally disposed because latch finger 55 is entrapped in the dog leg 43 of vertically rigid front band 37. Yet the flex arm 53 (and, hence, the latch finger 55) is movable in a force direction 40 normal to the front edge 37 of the shelf 11 because of the inherent spring or flexibility characteristics of the steel wire 46*a* from which same is fabricated.

Latch structure 50, as illustrated in FIG. 5, is provided at each of the adjacent front corners 48*a*, 48*b* of the shelf 11 is previously mentioned. And identical latch structure 50 may be provided at the adjacent rear corners 49*a*, 49*b* of the shelf assembly as shown, but this is not required. In the embodiment illustrated, and instead of providing a flex arm 53 at the rear corners of the shelf 11, the rearmost longitudinal support wire 46*b* is welded to the end transverse wires 49*a*, 49*b* at points 60*a*, 60*b*, see FIGS. 2 and 3. This, in effect, provides a fixed or immobile latch finger 55 at the rear corners 49*a*, 49*b* of each shelf 11. Otherwise the latch structure 50 at the rear corners 49*a*, 49*b* is the same as that at the front corners 48*a*, 48*b*. Alternatively, the latch fingers 55 at the rear corners 49*a*, 49*b* of the shelf 11 may be made flexible in the manner as described above for the latch fingers 55 at the front corners 48*a*, 48*b* of the shelf 11 simply by not welding support wire 46*b* to cross wires 49*a*, 49*b* at points 60*a*, 60*b*.

Note that the flex arms of latch structures 50 for the shelf's front corners 48*a*, 48*b* are oriented in the same vertical plane 61 when in the connect position, i.e., the post 14*a*, 14*b* latching attitude, that plane being parallel to the front 37 linear edge of the shelf 11, as illustrated in FIGS. 2 and 3. Note also that the plane 61 of the flex arms 53 is generally adjacent to the front face plane 31 of the shelf assembly 10. The flex arms 53 are generally linear in the connect position, and are both an integral part of the same longitudinal member 35 of the shelf 11, i.e., each flex arm 53 is in effect an integral part of the material support surface 29 of the shelf 11. Further, the latch finger 55 moves substantially coaxially with the adjacent corner post's hole 16 structure in response to face 40 because the flex axis 54 of the flex arm 53 is substantially removed from the front corner post 14 to be served (a distance L′ between five and six times the length of the latch finger 55 as shown in FIG. 5).

In use, and as is illustrated in FIGS. 1 and 2, initial positioning of a shelf 11*a* by the installer at the desired height location is achieved by first positioning latch fingers 55 at the rear corners 49*a*, 49*b* in holes 16 in the rear corner posts 15*a*, 15*b*. Note that these fingers 55 enter from the inside face 19 of the rear corner posts 15*a*, 15*b*, and that the rear dog legs' feet 43 thereby butt up against the rear corner posts as the shelf 11 is pushed against the rear corner posts by the installer along force direction 40. The shelf 11*a* is thereby initially positioned in connected relation with rear corner posts 15 while remaining in a tilted attitude relative to a horizontal plane, as illustrated in FIG. 1. This intermediate installation attitude can be achieved by an installer simply by manually gripping the shelf 11*a* at spaced positions along the front edge 37 thereof, and so connecting the shelf with the rear posts 15. Thereafter, the installer manually grips the support wire gridwork 46, 47 on the shelf 11 in hand grip areas 62 from underneath at each of the shelf's front corners 48*a*, 48*b* (which gridwork constitutes the hand grip means previously described). In this manual gripping attitude, the installer's right-hand thumb bears front-to-rear against the flex arm 53*a*, and the installer's righthand fingers grab, for example, fixed longitudinal wire 46*c* of the shelf 11*a* in the grip areas 62*a*, adjacent to righthand front corner post 14*a*. Further, the installer's lefthand thumb bears front-to-rear against the flex arm 53*b*, and the installer's lefthand fingers grab, for example, fixed longitudinal wire 46*c* of the shelf 11*a* in the grip area 62*b*, adjacent to lefthand front corner post 14*b*.

In this intermediate attitude, therefore, the installer can easily push flex arms 53*a*, 53*b* of the latch structures 50*a*, 50*b* in force direction 40 simply by exerting force thereon with both hands' thumbs while both hands' fingers grip the immobile grip areas 62*a*, 62*b* on the shelf (e.g., the longitudinal wire 46*c*), which force direction 40 is normal to the shelf's front edge 37.

After flexing the flex arms 53*a*, 53*b* into the solid line attitude illustrated in FIG. 2 (and the phantom line attitude illustrated in FIG. 5), the shelf 11*a* is simply pivoted or lowered about the horizontal pivot axis defined by the rearmost longitudinal wire 46*b* until the front edge 37 of the shelf is located in the same horizontal plane with the rear edge 38 of the shelf. Once this attitude has been achieved, the installer simply releases thumb pressure in force direction 40 against the flex arms 53*a*, 53*b*, thereby permitting those flex arms to move from the phantom line attitude illustrated in FIG. 5 into the solid line attitude, i.e., the connect position, illustrated in FIG. 5. In other words, and by removing the force in force direction 40 from the flex arms 53*a*, 53*b* once the front edge 37 of the shelf 11*a* has been horizontally disposed relative to the rear edge 38 of the shelf, the flex arms simply flex or spring back into the solid line attitude illustrated in FIGS. 3 and 5, in which solid line attitude, as previously explained, the latch fingers 55 are received in holes 16 in the front corner posts 14. Thus, the shelf structure is located in the desired horizontal attitude relative to the four corner posts of the shelf assembly, see shelf 11*c* in FIG. 1.

In other words, the flex arms 53 are in the form of end members movably mounted on opposite ends of the front of the shelf 11, each end member normally extending generally coextensively with the front of the shelf. Each end member 53 has a latch finger 55 or terminal insertion portion that extends forwardly therefrom. To install or remove the shelf, the end members or flex arms 53 are moved toward the rear posts 15, the latch finger or terminal insertion portion 55 of those end members being inserted from rear-to-front through the openings 16 in the front posts 14 for installation, and being removed from front-to-rear through the openings in the front post for removal, of the shelf 11. The distance between the latch fingers or terminal insertion portions 55 of the flex arms or end members 53, when in the normal extended condition on the front, is greater than the fixed distance between the front support posts 14, thereby requiring the ends to be moved or flexed out of position on the front of the shelf in order to remove the shelf from connected relation with the posts. Thus, the movable end members or flex arms 53 are at least partially free to move away from the front edge of the shelf 11 in order to bring those end members out of position on the front support so that the respective ends 55 may be inserted in respective openings 16 in the front posts 14.

Having described in detail the preferred embodiment of my invention, what I desire to claim and protect by Letters Patent is:

1. A shelf assembly comprising a front corner post having a plurality of holes along the length thereof, a shelf adapted to be positioned in a horizontal attitude, said shelf having a front edge and a rear edge, said shelf comprising a grid formed from a plurality of transverse members and a plurality of longitudinal members connected to said transverse members, latch structure connected with said shelf adjacent said front corner post, said latch structure comprising a flex arm connected at one end to said shelf and formed by one of said longitudinal members which has an end not connected to an outermost transverse member and hence is free to flex in the plane of said shelf, and a latch finger forming an extension of said flex arm and extending perpendicularly to the free end thereof, said flex arm being disposed generally parallel to the front edge of said shelf in a connect position at which said latch finger is received in said corner post hole, and said latch finger being retracted from that corner post hole in response to a force exerted on said flex arm in a direction generally normal to the front edge of said shelf, thereby permitting said shelf to be easily assembled with or disassembled from said front corner post by exerting manually a force on said flex arm in said generally normal force direction, a portion of said longitudinal members establishing a hand grip which can be manually engaged by one of the fingers and thumb of an installer's hand, one of said longitudinal support members comprising a front band of substantial vertical rigidity, said flex arm being formed integral with one of said longitudinal support members other than said front band, said latch finger passing through a dog leg at the corner of said shelf formed from said front band, thereby providing vertical force stability to said latch finger.

* * * * *